US009941650B2

(12) United States Patent
Tien et al.

(10) Patent No.: US 9,941,650 B2
(45) Date of Patent: Apr. 10, 2018

(54) ROTATING MECHANISM AND PLUG USING SAME

(71) Applicants: Fu Tai Hua Industry (Shenzhen) Co., Ltd., Shenzhen (CN); HON HAI PRECISION INDUSTRY CO., LTD., New Taipei (TW)

(72) Inventors: Li-Wen Tien, New Taipei (TW); Xue-Qing Liu, Shenzhen (CN); Run-Sun Zeng, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/605,973

(22) Filed: May 26, 2017

(65) Prior Publication Data

US 2017/0346249 A1 Nov. 30, 2017

(30) Foreign Application Priority Data

May 27, 2016 (CN) ..... 2016 1 0360189

(51) Int. Cl.
*H01R 13/44* (2006.01)
*H01R 35/04* (2006.01)
*H01R 31/00* (2006.01)

(52) U.S. Cl.
CPC ..... *H01R 35/04* (2013.01); *H01R 31/00* (2013.01)

(58) Field of Classification Search
CPC .... H01R 35/04; H01R 13/46; H01R 13/4532; H01R 31/00
USPC ..... 439/131
See application file for complete search history.

(56) References Cited

U.S. PATENT DOCUMENTS 7,104,813 B1 * 9/2006 Chuang ..... H01R 35/04 439/104
7,438,574 B2 * 10/2008 Neumann ..... H01R 13/4532 439/172
7,484,972 B1 * 2/2009 Kuo ..... H01R 35/04 439/131
8,979,549 B2 * 3/2015 Lin ..... H01R 13/46 439/31

FOREIGN PATENT DOCUMENTS

JP 2012209175 A * 10/2012 ..... H01R 13/46

* cited by examiner

*Primary Examiner* — Jean F Duverne
(74) *Attorney, Agent, or Firm* — ScienBiziP, P.C.

(57) ABSTRACT

A plug includes a housing, a rotating mechanism, and a pair of pins. The rotating mechanism has a holding member, and a rotating member. The holding member is secured in the housing, and has an elastic arcuate portion having a plurality of recesses. The rotating member is rotatable relative to the holding member, and has a projection mating with each of the recesses of the arcuate portion of the holding member. The pair of pins are secured to the rotating member. The projection of the rotating member is movable along the arcuate portion of the holding member and presses the arcuate portion such that the arcuate portion is elastically deformed until the projection engages one of the recesses of the arcuate portion. When the projection engages one of the recesses, the rotating member and the pair of pins are held in a specific orientation.

20 Claims, 6 Drawing Sheets

ROTATING MECHANISM AND PLUG USING SAME

CROSS REFERENCE TO RELATED APPLICATION

This application claims priority to Chinese Patent Application No. 201610360189.4, filed May 27, 2016, the contents of which are incorporated by reference in the entirety.

FIELD

The present disclosure relates to plugs, and more particularly to a rotating mechanism and a plug using the same.

BACKGROUND

A type of conventional plug comprises pins extending from an insulator, thereby increasing the risk of accidentally touching the pins. Another type of conventional plug comprises rotatable pins being able to be received in an insulator to overcome the above risk. However, the rotatable pins cannot be held in different orientations, thereby causing inconvenience in use.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
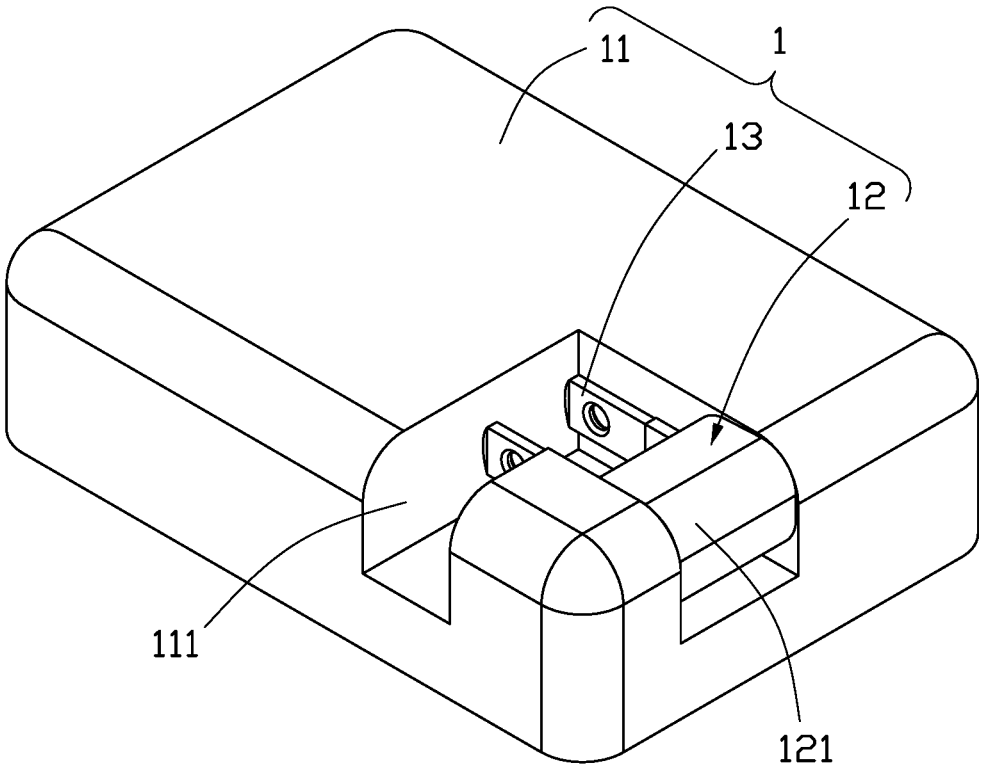
FIG. 1 is a schematic top perspective view of a plug of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein can be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" means "including but not limited to"; it specifically indicates open-ended inclusion or membership in the so-described combination, group, series, and the like.

Figure 2:
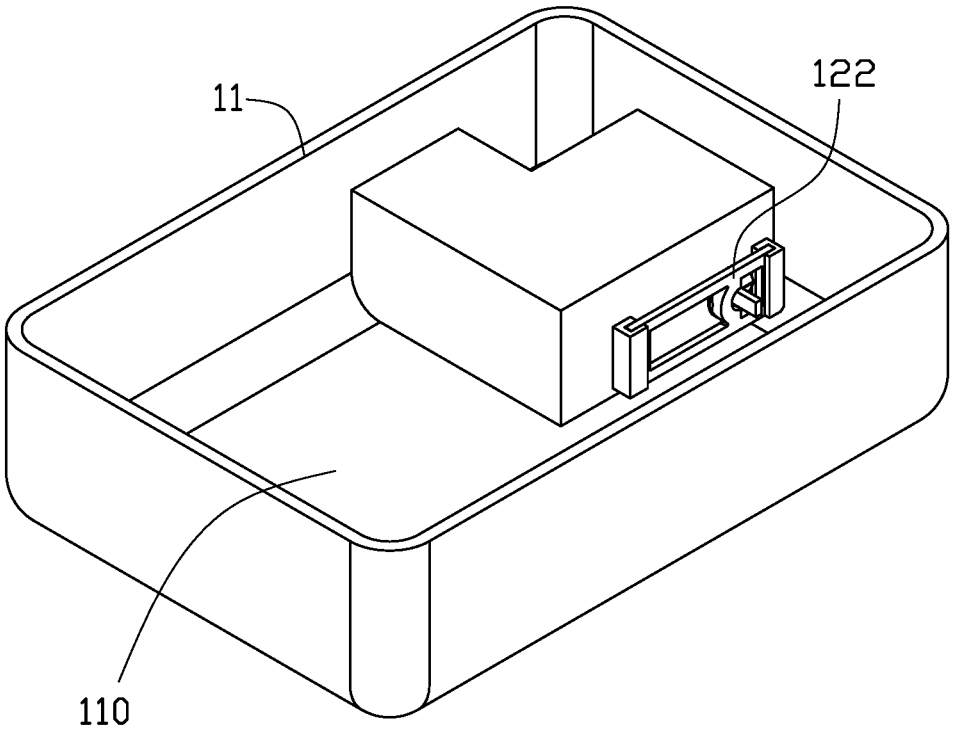
FIG. 2 is a schematic bottom perspective view of the plug of FIG. 1.

With reference to FIG. 1, an exemplary embodiment of a plug 1 includes a housing 11, a rotating mechanism 12, and a pair of pins 13. With further reference to FIG. 2, the housing 11 has a cavity 110. The rotating mechanism 12 has a rotating member 121, and a holding member 122. The holding member 122 is secured in the cavity 110 of the housing 11. The rotating member 121 is rotatably mounted on the housing 11, and is rotatable relative to the holding member 122. The pair of pins 13 are secured to the rotating member 121, and are rotated with the rotating member 121.

Figure 3:
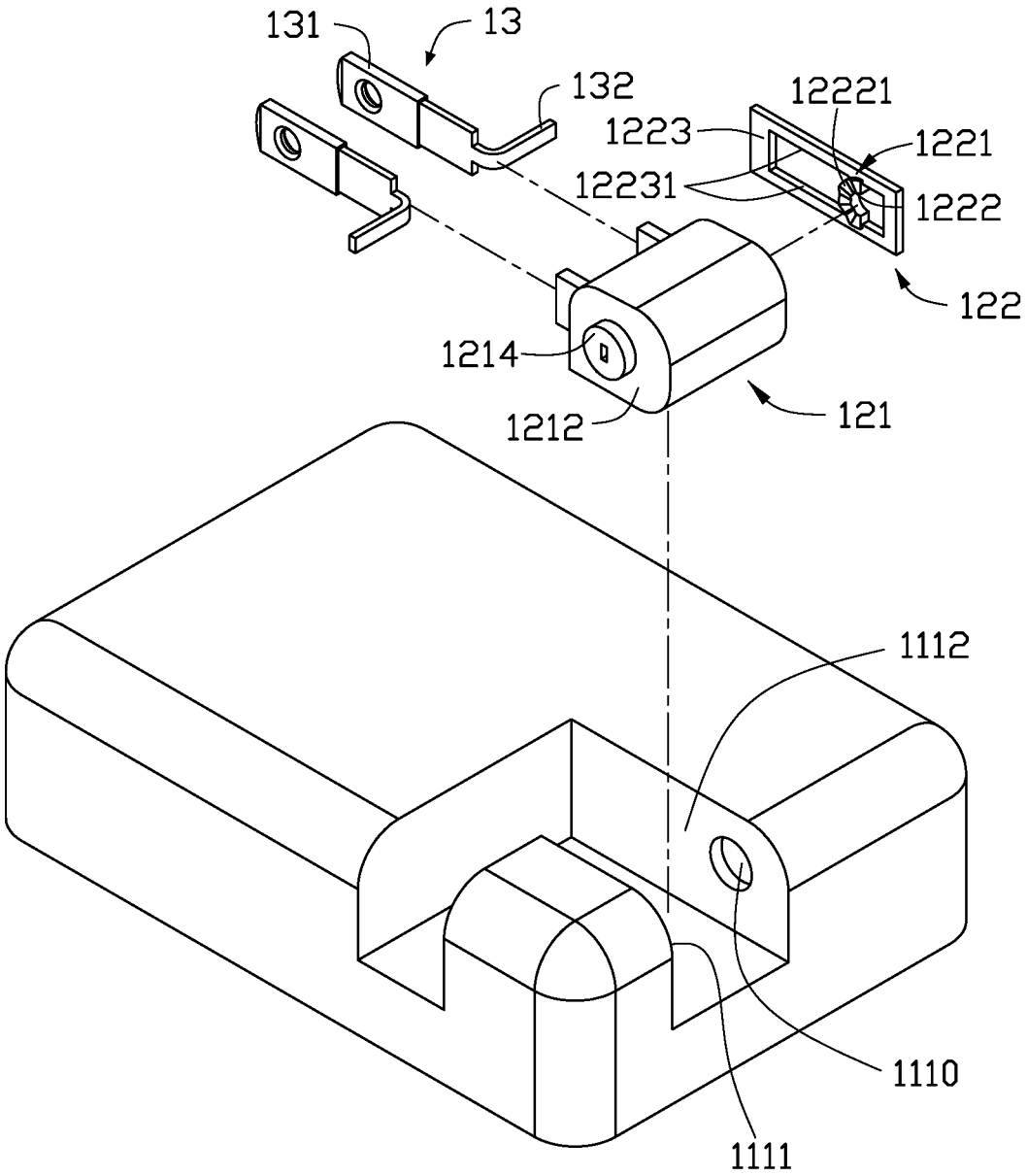
FIG. 3 is a schematic exploded top perspective view of the plug of FIG. 1.
Figure 4:
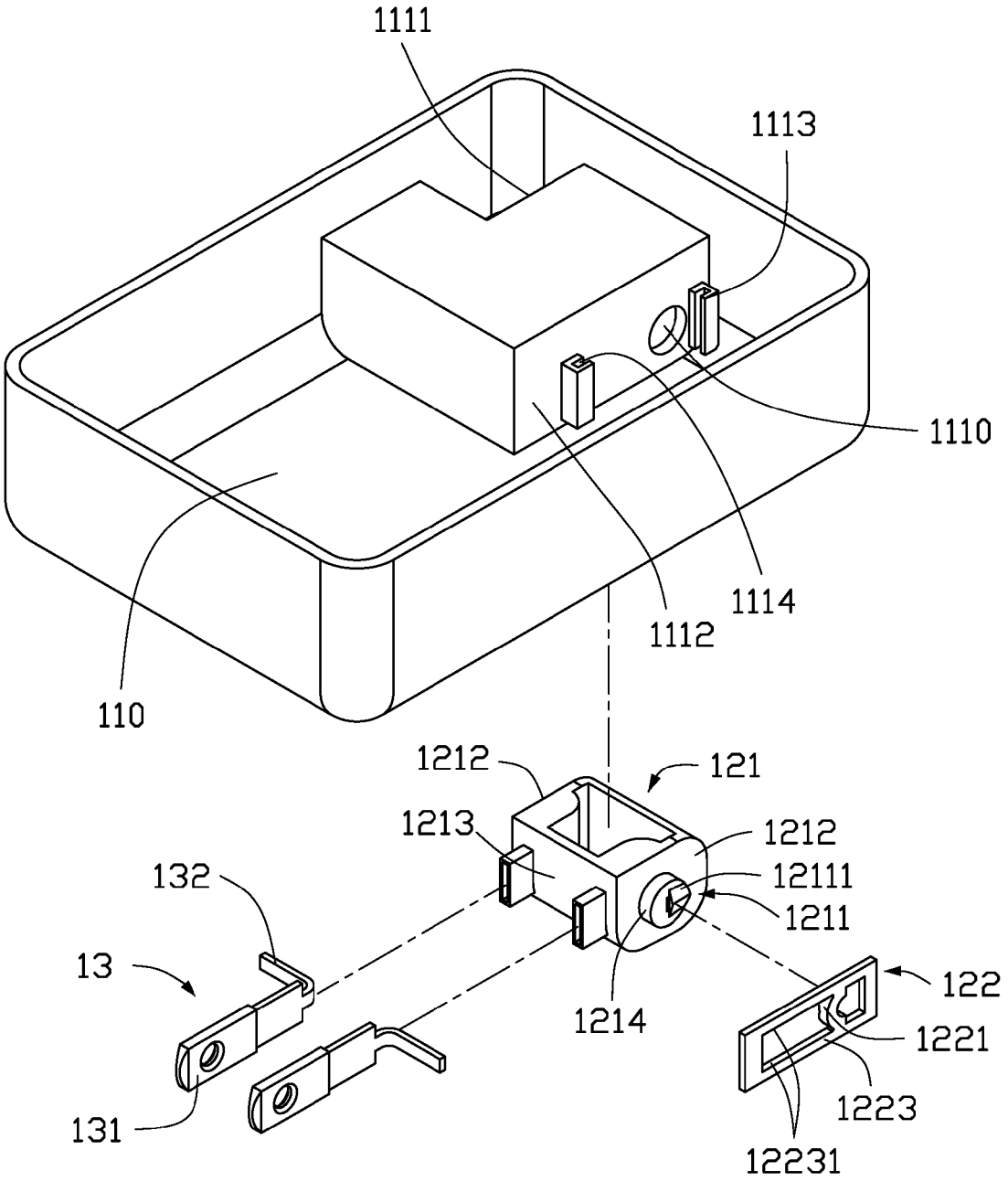
FIG. 4 is a schematic exploded bottom perspective view of the plug of FIG. 1.

In the present exemplary embodiment, the housing 11 has a notch 111 on one of four corners of its outer surface. The pair of pins 13 are rotated with the rotating member 121 and relative to the holding member 122 to project from or be received in the notch 111 of the housing 11. With reference to FIG. 3, the notch 111 has a first wall 1111, and a second wall 1112. The first and second walls 1111, 1112 are opposed to each other. Each of the first and second walls 1111, 1112 has a hole 1110. With further reference to FIG. 4, the rotating member 121 is hollow, is made of an insulating material such as plastic, and has two parallel side portions 1212, a connecting portion 1213, and two shafts 1214. The connecting portion 1213 is disposed between the side portions 1212. The two shafts 1214 respectively extend from the two side portions 1212 in a direction perpendicular to the side portions 1212. One of the shafts 1214 has a projection 1211 at its end, and the projection 1211 has two intersecting first inclined surfaces 12111. An angle between the first inclined surfaces 12111 is an obtuse angle. The shaft 1214 without the projection 1211 passes through the hole 1110 of the first portion 1111, and the shaft 1214 with the projection 1211 passes through the hole 1110 of the second portion 1112, such that the rotating member 121 is rotatably mounted on the housing 11. The projection 1211 extends from the hole 1110 of the second portion 1112 to be disposed in the cavity 110 of the housing 11.

In the present exemplary embodiment, the holding member 122 is secured to an inner surface of the second wall 1112 of the notch 111 by two connecting members 1113. The two connecting members 1113 extend from the inner surface of the second wall 1112 at two sides of the hole 1110 of the second wall 1112. Each connecting member 1113 is U-shaped in cross section, and has a slot 1114. Two sides of the holding member 122 are respectively received in the slots 1114 of the two connecting members 1113. The holding member 122 has a rectangular frame 1223, and an elastic arcuate portion 1221. The arcuate portion 1221 has two ends, and a plurality of recesses 1222. The two ends of the arcuate portion 1221 are respectively connected to two inner side surfaces 12231 of the frame 1223. Each recess 1222 has two second inclined surfaces 12221 mating with the first inclined surfaces 12111 of the projection 1211 of the shaft 1214 of the rotating member 121. One of the recesses 1222 engages the projection 1211 of the shaft 1214 of the rotating member 121.

In the present exemplary embodiment, each pin 13 is bent to be L-shaped, and has a first end 131 and a second end 132. The first end 131 of the pin 13 extends from the connecting portion 1213 of the rotating member 121 for inserting into a socket. The second end 132 of the pin 13 extends from the shaft 1214 of the rotating member 121 for connection with a conducting element (not shown) inside the plug 1.

In use, a force is applied to rotate the rotating member 121 about an axis of the shaft 1214 so as to move the projection 1211 of the shaft 1214 of the rotating member 121 along the arcuate portion 1221 of the holding member 122, and the projection 1211 presses the arcuate portion 1221 such that the arcuate portion 1221 is elastically deformed until the projection 1211 engages one of the recesses 1222 of the arcuate portion 1221. When the projection 1211 engages one of the recesses 1222, the rotating member 121 and the pair of pins 13 secured to the rotating member 121 are held in a specific orientation, thereby facilitating a user to use the plug 1.

In order to hold the rotating member 121 and the pair of pins 13 more stable, the areas of the first inclined surfaces 12111 of the projection 1211 and the second inclined surfaces 12221 of the recesses 1222 can be increased so as to increase the contact area therebetween. In the present exemplary embodiment, the holding member 122 is integrally formed of an elastic material, an angle of the arcuate portion 1221 of the holding member 122 is 180 degrees, and the number of the recesses 1222 of the arcuate portion 1221 is three.

Figure 5:
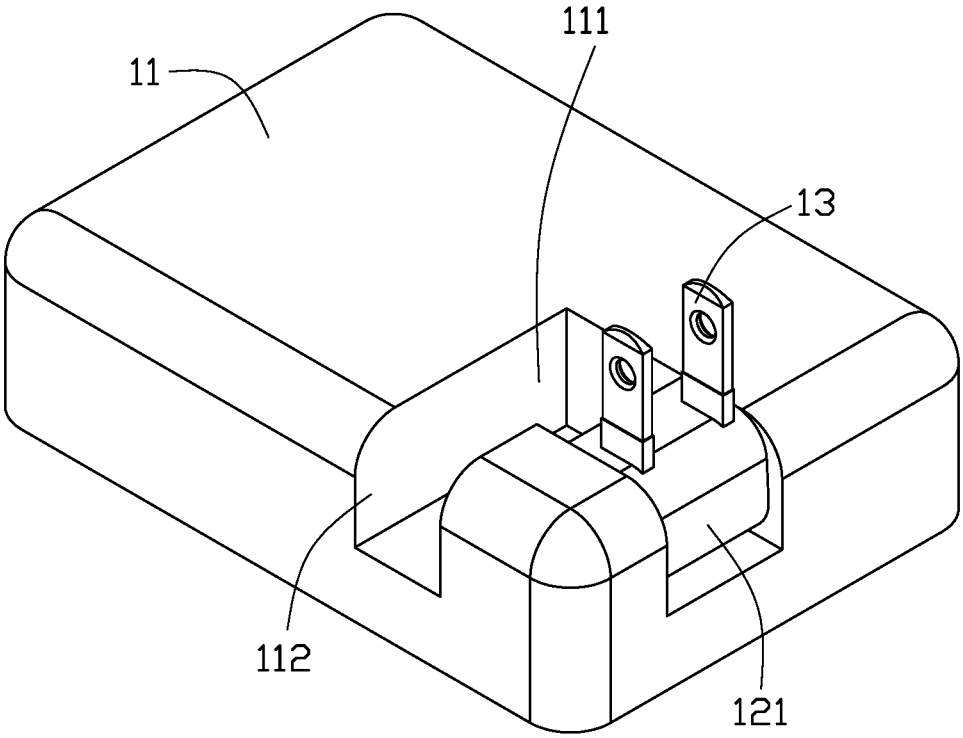
FIGS. 5 and 6 are schematic top perspective views of the plug of FIG. 1, showing a pair of pins being held in different orientations.
Figure 6:
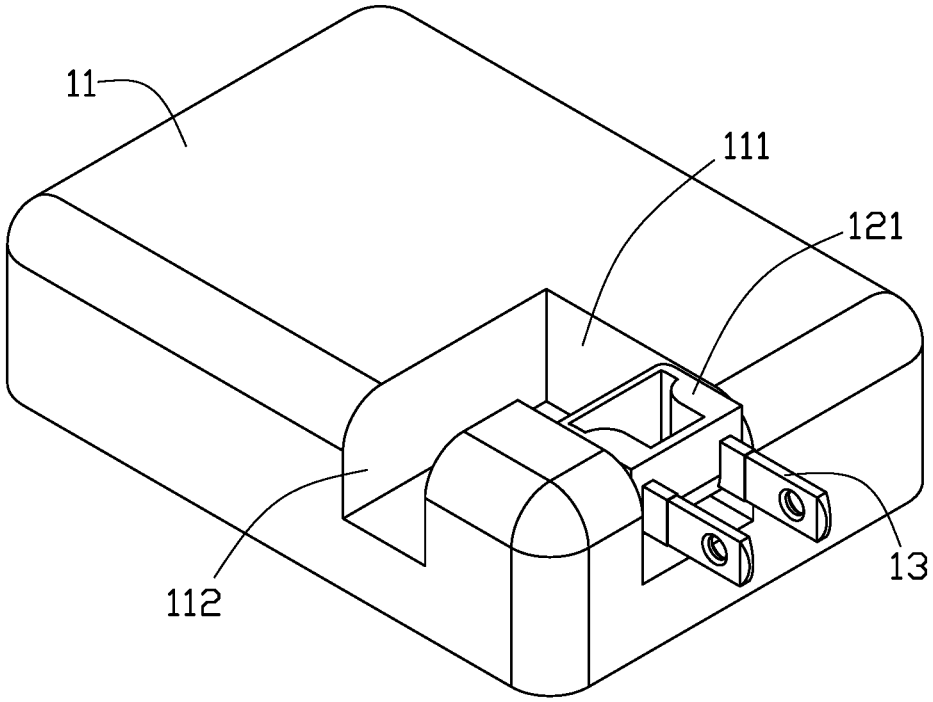

With reference to FIGS. 5 and 6, in the present exemplary embodiment, the notch 111 of the housing 11 is L-shaped, and has an opening 112. When the pair of pins 13 are received in the notch 111 of the housing 11, the user can easily rotate the pins 13 through the opening 112.

The exemplary embodiments shown and described above are only examples. Many details are often found in the art such as the other features of a rotating mechanism and a plug. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the exemplary embodiments described above may be modified within the scope of the claims.

What is claimed is:

1. A rotating mechanism comprising:

a holding member having an elastic arcuate portion having a plurality of recesses; and a rotating member being rotatable relative to the holding member, and having a projection mating with each of the recesses of the arcuate portion of the holding member;

wherein the projection of the rotating member is movable along the arcuate portion of the holding member and presses the arcuate portion such that the arcuate portion is elastically deformed until the projection engages one of the recesses of the arcuate portion; and wherein the rotating member is rotable to selectively, by the projection, contact and break contact with the holding member.

2. The rotating mechanism of claim 1, wherein the projection of the rotating member has two intersecting first inclined surfaces; and wherein each recess of the arcuate portion of the holding member has two second inclined surfaces mating with the first inclined surfaces of the projection of the rotating member.

3. The rotating mechanism of claim 2, wherein an angle between the first inclined surfaces is an obtuse angle.

4. The rotating mechanism of claim 1, wherein the rotating member further has two side portions and two shafts respectively extending from the two side portions in a direction perpendicular to the side portions, and the projection is formed on one of the shafts.

5. The rotating mechanism of claim 2, wherein the rotating member further has two side portions and two shafts respectively extending from the two side portions in a direction perpendicular to the side portions, and the projection is formed on an end of one of the shafts.

6. The rotating mechanism of claim 3, wherein the rotating member further has two side portions and two shafts respectively extending from the two side portions in a direction perpendicular to the side portions, and the projection is formed on an end of one of the shafts.

7. The rotating mechanism of claim 1, wherein the holding member further has a rectangular frame having two inner side surfaces, and two ends of the arcuate portion are respectively connected to the two inner side surfaces of the frame.

8. The rotating mechanism of claim 2, wherein the holding member further has a rectangular frame having two inner side surfaces, and two ends of the arcuate portion are respectively connected to the two inner side surfaces of the frame.

9. The rotating mechanism of claim 3, wherein the holding member further has a rectangular frame having two inner side surfaces, and two ends of the arcuate portion are respectively connected to the two inner side surfaces of the frame.

10. The rotating mechanism of claim 4, wherein the holding member further has a rectangular frame having two inner side surfaces, and two ends of the arcuate portion are respectively connected to the two inner side surfaces of the frame.

11. A plug comprising:

a housing;

a rotating mechanism having:

a holding member secured in the housing, and having an elastic arcuate portion having a plurality of recesses; and a rotating member rotatably mounted on the housing, being rotatable relative to the holding member, and having a projection mating with each the recesses of the arcuate portion of the holding member; and a pair of pins secured to the rotating member;

wherein the projection of the rotating member is movable along the arcuate portion of the holding member and presses the arcuate portion such that the arcuate portion is elastically deformed until the projection engages one of the recesses of the arcuate portion; and wherein the rotating member is rotable to selectively, by the projection, contact and break contact with the holding member.

12. The plug of claim 11, wherein the projection of the rotating member has two intersecting first inclined surfaces, and wherein each recess of the arcuate portion of the holding member has two second inclined surfaces mating with the first inclined surfaces of the projection of the rotating member.

13. The plug of claim 11, wherein the rotating member further has two side portions and two shafts respectively extending from the two side portions in a direction perpendicular to the side portions, and the projection is formed on one of the shafts.

14. The plug of claim 12, wherein the rotating member further has two side portions and two shafts respectively extending from the two side portions in a direction perpendicular to the side portions, and the projection is formed on one of the shafts.

15. The plug of claim 13, wherein the housing has a notch for receiving the pair of pins, and the notch has a first wall, and a second wall; and wherein the shaft of the rotating member without the projection passes through the first wall of the notch of the housing, and the shaft of the rotating member with the projection passes through the second wall of the notch of the housing, such that the rotating member is rotatably mounted on the housing, the projection extends from the second wall to be disposed in the housing, and the holding member is secured to an inner surface of the second wall.

16. The plug of claim 14, wherein the housing has a notch for receiving the pair of pins, and the notch has a first wall, and a second wall; and wherein the shaft of the rotating member without the projection passes through the first wall of the notch of the housing, and the shaft of the rotating member with the projection passes through the second wall of the notch of the housing, such that the rotating member is rotatably mounted on the housing, the projection extends from the second wall to be disposed in the housing, and the holding member is secured to an inner surface of the second wall.

17. The plug of claim 13, wherein the rotating member further has a connecting portion disposed between the side portions; and wherein each pin is bent, and has:

a first end extending from the connecting portion of the rotating member; and a second end extending from the shaft of the rotating member.

18. The plug of claim 14, wherein the rotating member further has a connecting portion disposed between the side portions; and wherein each pin is bent, and has:

a first end extending from the connecting portion of the rotating member; and a second end extending from the shaft of the rotating member.

19. The plug of claim 15, wherein the rotating member further has a connecting portion disposed between the side portions; and wherein each pin is bent, and has:

a first end extending from the connecting portion of the rotating member; and a second end extending from the shaft of the rotating member.

20. The plug of claim 11, wherein an angle of the arcuate portion of the holding member is 180 degrees.

* * * * *